United States Patent [19]

Hayatdavoudi et al.

[11] Patent Number: 4,488,607

[45] Date of Patent: Dec. 18, 1984

[54] SEPARATOR SUB WITH ANNULAR FLOW PASSAGE

[75] Inventors: Asadollah Hayatdavoudi, Lafayette, La.; Ladd M. Adams, Norman, Okla.

[73] Assignee: Petroleum Instrumentation & Technological Services, Lafayette, La.

[21] Appl. No.: 423,515

[22] Filed: Sep. 27, 1982

[51] Int. Cl.[3] ..... E21C 7/08

[52] U.S. Cl. ..... 175/65; 175/339; 175/337; 210/788

[58] Field of Search ..... 175/65, 67, 69, 70, 175/337, 339, 340, 213, 324; 166/105.5, 105.6, 243; 210/787, 788, 512.1

[56] References Cited

U.S. PATENT DOCUMENTS

| | | | |
|---|---|---|---|
| 2,056,498 | 10/1936 | Wright . | |
| 2,072,627 | 3/1937 | Zublin . | |
| 2,260,487 | 10/1941 | Scott . | |
| 2,340,738 | 2/1944 | Dilley . | |
| 2,634,101 | 4/1953 | Sloan . | |
| 2,861,780 | 11/1958 | Butler . | |
| 2,894,727 | 7/1959 | Henderson . | |
| 2,920,872 | 1/1960 | Baur et al. . | |
| 2,946,565 | 7/1960 | Williams . | |
| 3,259,246 | 7/1966 | Stavenger | 210/512.1 |
| 3,289,608 | 12/1966 | Laval | 210/512.1 |
| 3,404,778 | 10/1968 | Woodruff et al. | 210/787 |
| 3,844,362 | 10/1974 | Elbert et al. . | |
| 3,908,771 | 9/1975 | Garrett . | |
| 3,924,695 | 12/1975 | Kennedy . | |
| 3,996,027 | 12/1976 | Schnell et al. | 210/512.1 |
| 4,070,171 | 1/1978 | Wikdahl . | |
| 4,083,417 | 4/1978 | Arnold . | |
| 4,092,130 | 5/1978 | Wikdahl . | |
| 4,156,470 | 5/1979 | Bodine et al. . | |
| 4,222,447 | 9/1980 | Cholet . | |
| 4,223,747 | 9/1980 | Marais . | |
| 4,239,087 | 12/1980 | Castel et al. . | |
| 4,240,513 | 12/1980 | Castel et al. . | |
| 4,245,710 | 1/1981 | Dolezal et al. . | |

*Primary Examiner*—Stephen J. Novosad
*Assistant Examiner*—Mark J. DelSignore
*Attorney, Agent, or Firm*—Charles C. Garvey

[57] ABSTRACT

Apparatus and methods are disclosed for drilling a well. A separator sub includes a cyclone separator which separates a stream of drilling mud into a less dense first portion and more dense second portion. The stream of drilling mud flows downward in an annular stream around the cyclone separator and then flows into a lower end of the cyclone separator. The less dense first portion of the stream of drilling mud is directed from the cyclone separator downward to a drill bit so that the drilling mud adjacent the drill bit has a density less than an initial density of the stream of drilling mud. The more dense second portion of the stream of drilling mud is directed upward from the cyclone separator and is ejected into a well annulus with an upward component of velocity and thereby reduces a hydrostatic drilling mud pressure adjacent the drill bit.

15 Claims, 4 Drawing Figures

SEPARATOR SUB WITH ANNULAR FLOW PASSAGE

The present invention relates generally to apparatus for drilling oil wells, and more particularly, to a downhole drilling apparatus which has a cyclone separator disposed therein for separating the drilling mud into a more dense portion and a less dense portion. The less dense portion is directed downward to the drill bit. The more dense portion is ejected upwardly into a well annulus to decrease a hydrostatic pressure in the well annulus above the drill bit.

During the drilling of an oil well, drilling mud is directed downward through a drill string which has a drill bit attached to the lower end thereof. The drilling mud is directed out of nozzles in the drill bit and is directed toward the bottom of the hole which is being drilled.

This drilling mud washes cuttings and the like from the face of the bit, and also serves to cool the drill bit. The drilling mud then flows back upwards through the well annulus between the drill string and the well bore hole carrying the cuttings along with it.

This drilling mud is typically thickened or weighted with additives to make it more dense, so that the hydrostatic head of the column of drilling mud in the well annulus will be sufficient to prevent blowout of the subsurface formations intersected by the well.

This heavy column of drilling mud does, however, create several effects adverse to the drilling operation.

For example, it is known that the cutting efficiency of a rotary drill bit is increased by decreasing the density of the drilling fluid within which the drill bit is working.

It is also known that the drilling efficiency of a drill bit is increased by decreasing the hydrostatic head of the drilling mud in the annulus above the drill bit. This efficiency increase is provided because the hydrostatic head tends to hold cuttings down on the bottom of the bore hole. By decreasing the hydrostatic head the cuttings are more easily removed from the bottom of the bore hole.

The prior art includes numerous devices for ejecting drilling mud upwardly into a well annulus to thereby decrease the hydrostatic head of the drilling mud in that annulus. The present invention, however, provides an apparatus which takes advantage of both of these techniques of increasing drilling efficiency.

By the present invention, the downwardly directed stream of drilling mud flowing through the drill string is separated in a separator sub into a less dense first portion and a more dense second portion.

The less dense first portion is then directed downward to the drill bit so that the drilling mud adjacent the drill bit has a density less than an initial density of the stream of drilling mud in the drill string.

The more dense second portion of the stream of drilling mud is directed into the well annulus with an upward component of velocity at an elevation above the drill bit, and thereby reduces the hydrostatic drilling mud pressure adjacent the drill bit. Thus by the apparatus and methods of the present invention, the density of the drilling mud adjacent the drill bit is reduced thus increasing the drilling efficiency, and the hydrostatic head of the column of drilling mud above the drill bit is reduced thus further increasing the efficiency of the drilling operation.

Numerous objects, features and advantages of the present invention will be readily apparent to those skilled in the art in view of the following disclosure when taken in conjunction with the accompanying drawings.

DETAILED DESCRIPTION OF THE PREFERRED EMBODIMENT

Figure 1:
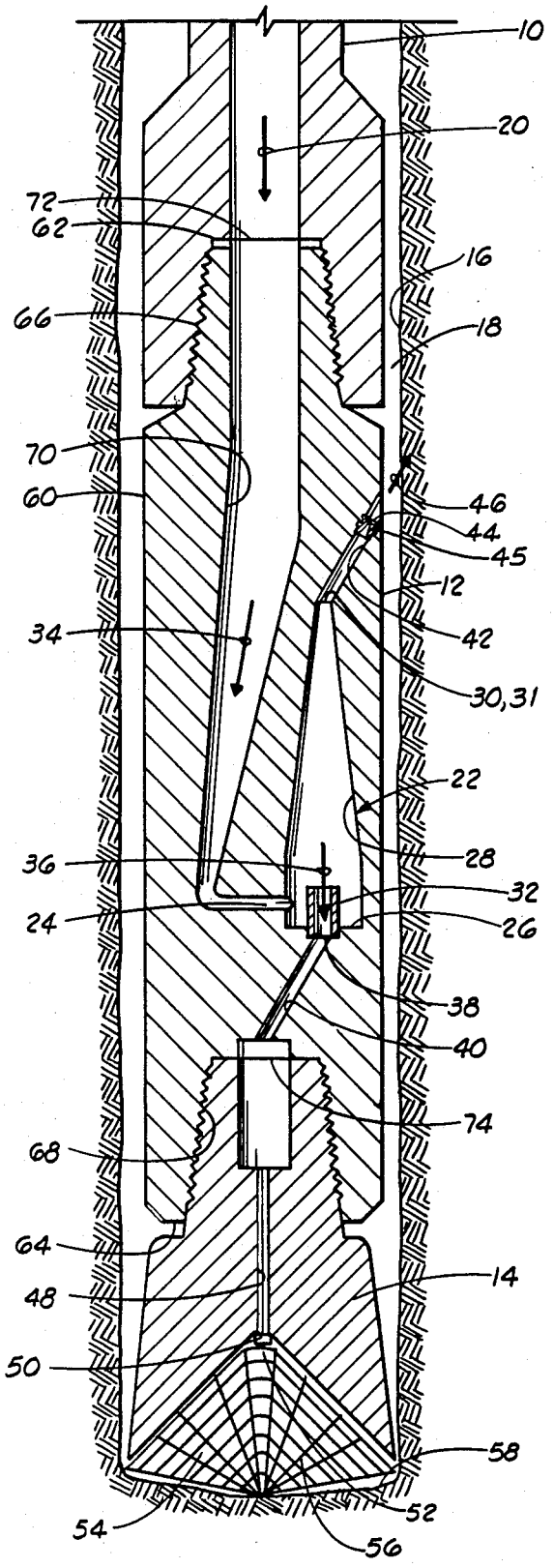
FIG. 1 is a schematic elevation view of a rotary drill bit attached to a drill string including the separator sub of the present invention.

Referring now to the drawings, and particularly to FIG. 1, a drill string 10 has a separator sub 12 connected to the lower end thereof. A drill bit 14 is connected to the lower end of the separator sub.

The drill bit 14 is rotated to drill a well bore 16. A well annulus 18 is defined between the drill string 10 and the well bore 16. The separator sub 12 may itself be considered a part of the drill string 10 when referring to the annulus 18 between the drill string 10 and the well bore 16.

By the methods of the present invention, a stream of drilling mud is directed downward through the pipe string 10 toward the drill bit 14 as indicated by the arrow 20.

Disposed in the separator sub 12 is a cyclone separator 22 for separating the stream of drilling mud into a less dense first portion and a more dense second portion.

The stream of drilling mud flows downward past the cyclone separator 22 as indicated by arrow 34 and is directed tangentially into a cyclone inlet 24 adjacent a lower end 26 of a cyclone chamber 28 of the cyclone separator 22. The cyclone chamber 28 tapers upward from the larger lower end 26 to a smaller upper end 30.

This stream of drilling mud is tangentially directed into the larger lower end 26 adjacent an axial vortex finder tube 32 extending upward into the cyclone chamber 28.

When the drilling mud is directed tangentially into the lower end 26 of the cyclone chamber 28, a swirling motion is imparted to the stream of drilling mud in the lower end 26 of the cyclone chamber 28.

This swirling stream of drilling mud then flows upward toward the smaller diameter upper end 30 of the cyclone chamber 28.

The cyclone chamber 28 separates this upward flowing, swirling stream of drilling mud into a less dense portion near the center of the chamber 28 and a more dense portion towards the periphery of the chamber 28.

The less dense first portion of the stream of drilling mud is withdrawn downwardly through the vortex finder tube 32 as indicated by arrow 36. The lower end 38 of vortex finder tube 32 may be referred to as an overflow outlet of the cyclone chamber 28. This less dense first portion of the stream of drilling mud then flows through an overflow passage 40 to the drill bit 14.

The more dense second portion of the stream of drilling mud flows upward through an underflow outlet of the cyclone chamber 28 which underflow outlet 31 is coincident with the upper end 30 of the chamber 28.

This more dense second portion then flows through an underflow passage means 42 and is ejected through a nozzle 45 disposed in an underflow passage outlet 44. This fluid is ejected from the nozzle 45 into the well annulus 18 in a direction as indicated by the arrow 46 which includes an upward component of velocity. This more dense second portion of the stream of drilling mud which is ejected into the annulus 18 with the upward component of velocity is flowing at a very high rate and serves to reduce the hydrostatic head of the column of drilling mud in the annulus 18.

Thus, the hydrostatic head of the drilling mud in the well annulus 18 adjacent the drill bit 14 is reduced thereby increasing the drilling efficiency of the drill bit 14.

The less dense first portion of the drilling fluid which flows through the overflow passage 40 flows through a drill bit passage 48 in the drill bit 14 to a nozzle 50 which ejects the less dense portion of fluid downwardly as indicated at 52 to wash cuttings and the like from between the cones 54, 56 of the drill bit 14 and away from a bottom 58 of the bore hole 16. The drilling mud ejected from the nozzle 50 is less dense than that drilling mud flowing downward through the pipe string 10, thus increasing the efficiency of the drill bit 14 as compared to the efficiency that would be present if the drilling mud in the pipe string 10 went directly to the drill bit 14 without going through the separator sub 12.

As an example of the separation provided by cyclone separator 22, it is anticipated that if the drilling mud flowing through drill string 10 has a mud weight of 14.0 pounds per gallon, the overflow fluid may have a mud weight of 13.5 and the underflow fluid may have a mud weight of 14.5. Two or more separator subs 12 may be stacked to increas this effect The separator sub 12 as schematically illustrated in FIG. 1, may generally be described as having a cylindrical body 60 having upper and lower ends 62 and 64 with threaded connecting means 66 and 68, respectively, on the upper and lower ends.

The cyclone chamber 28 is vertically disposed in the cylindrical body 60 and has the larger diameter circular lower end 26 and tapers upward to the smaller diameter upper end 30.

The cylindrical body 60 has an inlet passage means 70 disposed therein and communicates a flow inlet 72 of the upper end 62 of body 60 with the tangentially directed cyclone inlet 24 adjacent the lower end 26 of cyclone chamber 28.

The vortex finder tube 32 extends upward from the lower end 26 of cyclone chamber 28 and communicates with the overflow outlet 38 of the chamber 28. The vortex finder tube 32 is concentrically disposed within the chamber 28.

The overflow passage means 40 is disposed in the body 60 and communicates the overflow outlet 38 with a flow outlet 74 of the lower end 64 of the body 60.

The underflow passage means 42 is disposed in the body 60 and communicates the underflow outlet 31 of the upper end 30 of the chamber 28 with the ejection nozzle 45 disposed in the underflow passage outlet 44. The ejection nozzle 45 is oriented to eject the more dense second portion of the stream of drilling mud into the well annulus 18 surrounding the body 60 with an upward component of velocity as indicated by the arrow 46.

Figure 2:
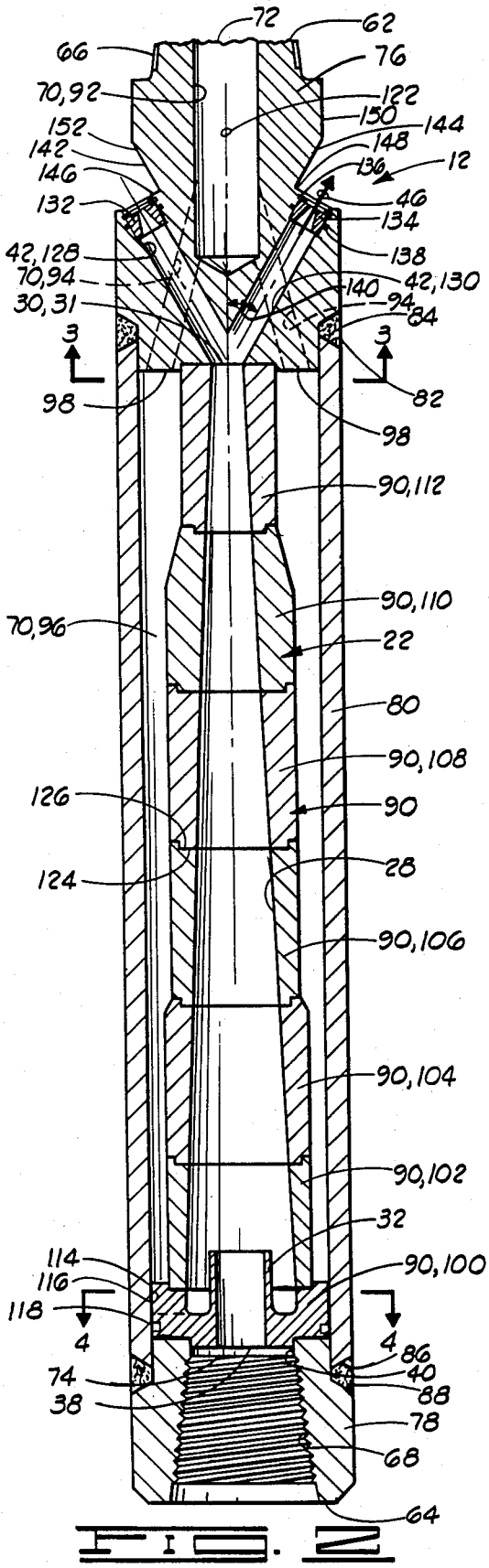
FIG. 2 is a section elevation view of a preferred embodiment of the separator sub of the present invention.

Referring now to FIG. 2, a preferred embodiment of the separator sub 12 is there illustrated in a section elevation view.

The separator sub 12 includes an upper adapter 76 and a lower adapter 78.

A tubular outer housing 80 has an upper end 82 connected to the upper adapter means 76 by welding as indicated at 84. Outer housing 80 has a lower end 86 connected to lower adapter 78 by welding as indicated at 88.

A cyclone housing 90 is disposed within and spaced radially inward from the outer housing 80.

The inlet passage means 70 shown schematically in FIG. 1, includes an inlet bore 92 disposed in upper adapter 76, a plurality of intermediate passageways 94 having their upper ends communicated with the bore 92, and an annular flow passage means 96 defined between outer housing 80 and cyclone housing 90 and having its upper end communicated with the lower ends 98 of the intermediate passageways 94.

Figure 3:
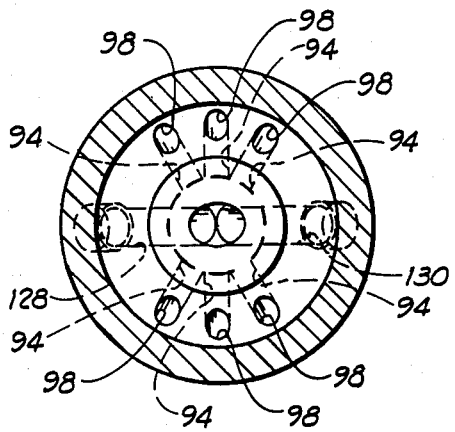
FIG. 3 is an upward horizontal section view taken along line 3—3 of FIG. 2 illustrating the various passageways in the upper adapter.
Figure 4:
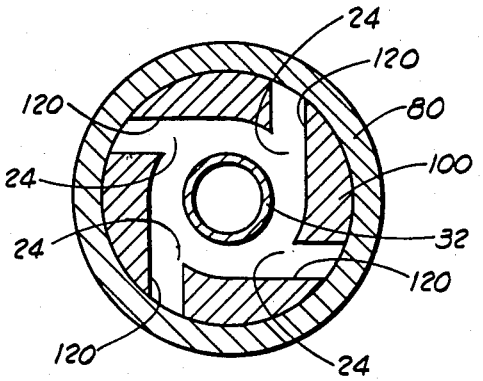
FIG. 4 is a downward horizontal section view taken along line 4—4 of FIG. 2 illustrating the tangential cyclone inlets.

As is best seen in FIG. 3, there are preferably six intermediate passageways 94 circumferentially spaced about the central bore 92 of upper adapter 76. These intermediate passageways 94 extend downward and radially outward from bore 92 to annular passageway 96.

The cyclone housing 90 is comprised of a plurality of axially stacked cyclone housing segments 100, 102, 104, 106, 108, 110 and 112.

The lowermost cyclone housing segment 100 is an integrally machined part having a cylindrical outer surface 114 closely received within a bore 116 of outer housing 80 with an annular resilient seal means 118 being disposed therebetween.

Lowermost cyclone housing segment 100 has the vortex finder tube 32 extending axially upward therefrom.

A plurality of tangentially oriented intermediate flow passageways 120 are machined in segment 100 and are open at their upper sides as viewed in FIG. 2.

These intermediate flow passageways 120 communicate the lower end of annular flow passage means 96 with a plurality of tangentially oriented cyclone inlets 24.

These intermediate flow passageways 120 are circumferentially spaced around a central longitudinal axis 122 of the separator sub 12.

The segments 100–112 of the cyclone housing 90 are each individually machined segments. The purpose of individually machining these segments is to allow the long internal taper of cyclone chamber 28 to be manufactured. It would be very difficult to machine the entire tapered internal surface of cyclone chamber 28 in a single piece of metal. Thus, the segments 100–112 are individually machined and then assembled together to form the cyclone housing 90.

Any two adjacent segments, such as, for example, segments 106 and 108, have an engaging tongue 124 and groove 126 which maintains the alignment of the portions of the internal surface of chamber 28 when the adjacent segments are fitted together.

Preferably, the cyclone housing 90 is constructed in the following manner.

After the various individual parts illustrated in FIG. 2, including the upper adapter 76, outer housing 80, lower adapter 78, and the segments 100–112 of cyclone housing 90 are individually machined, the upper and lower adapters 76 and 78 and the outer housing 80 are heated to cause them to expand in size due to thermal expansion.

The segments 100–112 of the cyclone housing 90 are not heated.

The segments 100–112 of cyclone housing 90 are fitted together as illustrated in FIG. 2, and preferably a liquid adhesive sealant, such as conventional liquid gasket material, is placed between each of the engaging tongue and groove faces, such as 124 and 126.

The unheated cyclone housing 90 is then placed within and assembled with the heated upper and lower adapters 76 and 78 and the heated outer housing 80. The outer housing 80 is then welded to the upper and lower adapters 76 and 78 as indicated at 84 and 88 before the outer housing 80 and the upper and lower adapters 76 and 78 are cooled.

Then, as the upper and lower adapters 76 and 78 and the outer housing 80 cool down, the outer housing 80 contracts thus placing the axially stacked segments 100–112 of cyclone housing 90 in a state of high axial compression. This axial compression, along with the tongue and groove engaging surfaces such as 124, 126, and the liquid adhesive placed between the tongue and groove surfaces, holds the axially stacked segments 100–112 in place in the orientation shown in FIG. 2 and prevents any leakage between the adjoining segments.

The underflow outlet 31 of cyclone chamber 28 is defined by the open upper end of uppermost segment 112 of cyclone housing 90.

The underflow passage means 42 preferably includes first and second underflow passage portions 128 and 130 spaced circumferentially at an angle of 180° apart about the longitudinal axis 122 of separator sub 12.

Disposed in the upper ends of the first and second underflow passage portions 128 and 130 are ejection nozzles 132 and 134, respectively.

The nozzles 132 and 134 are preferably similar to the typical types of nozzles used with rotary drill bits such as the nozzle 50 shown schematically in FIG. 1.

The nozzle 134, for example, is held in place within second underflow passage portion 130 by a lock ring 136.

The nozzle 134 is closely received within the second underflow passage portion 130 and an annular resilient seal means 138 is provided therebetween.

The more dense second portion of drilling mud from the cyclone separator 22 is ejected from the nozzles 132, 134 as indicated by arrow 46 at an angle 140 to the longitudinal axis 122 of separator sub 12. The angle 140 is preferably in the range of about 30° to 45°. In the embodiment illustrated in FIG. 2, the angle is illustrated as 30°.

The upper adapter 76 preferably has first and second ejection pockets 142 and 144 disposed in an outer surface thereof. The upper ends of the first and second underflow passage portions 128 and 130 communicate with flat surfaces 146 and 148 of first and second ejection pockets 142 and 144, respectively.

The ejection pockets 142 and 144 are open ejection pockets which are arranged so that the more dense second portion of the stream of drilling mud which is ejected from the nozzles 132 and 144 of the first and second underflow passage portions 128 and 130 will pass directly through the open pockets 142 and 144 into the well annulus 18 without any substantial impingement on any structure attached to the upper adapter means 76.

Preferably, the upper adapter 76 has a reduced diameter outer cylindrical surface 150 above the pockets 142 and 144, thus minimizing any overhanging structure which might be impinged upon by the jets of fluid exiting the nozzles 132 and 134. This cylindrical outer surface 150 is joined at its lower end by a downwardly tapered frusto-conical surface 152 which is joined at its lower end to the flat surfaces 146 and 148.

Thus, it is seen that the apparatus and methods of the present invention readily achieve the ends and advantages mentioned as well as those inherent therein.

While certain preferred embodiments of the invention have been illustrated for the purposes of this disclosure, numerous changes in the arrangement and construction of parts and steps may be made by those skilled in the art, which changes are encompassed within the scope and spirit of the present invention as defined by the appended claims.

What is claimed is:

1. An apparatus for use in the drilling of a well with a drill bit supported by an elongated drill string having a bore through which a stream of drilling mud circulates to remove cuttings of the drill bit, comprising:

a. an upper adapter means for connecting said apparatus to a drill string;

b. a lower adapter means for connecting said apparatus to a drill bit;

c. a tubular outer housing having an upper end connected to said upper adapter means and having a lower end connected to said lower adapter means;

d. a cyclone housing, disposed within and spaced radially inward from said outer housing to defining an annular flow passage therebetween;

e. cyclone separator means within the cyclone housing for separating a stream of drilling mud into a less dense first portion and a more dense second portion;

f. an annular flow passage means, disposed about said cyclone separator means, for flowing said stream of drilling mud downward toward a cyclone inlet means adjacent a lower end of a cyclone chamber of said cyclone separator means;

g. first conduit means for directing said less dense first portion of said stream of drilling mud downward from said cyclone separator means to a drill bit;

h. second conduit means for directing said more dense second portion of said stream of drilling mud into a well annulus above said drill bit with an upward component of velocity and for thereby reducing hydrostatic drilling mud pressure adjacent said drill pipe; and i. said upper adapter means has a central bore therein arranged to be communicated with an inner bore of said drill string, and has a plurality of intermediate passageways disposed therein communicating said central bore with an upper end of said annular flow passage means, said intermediate passageways being circumferentially spaced around said central bore.

2. The apparatus of claim 1, wherein:

said second conduit means is further characterized as an underflow passage means disposed in said upper adapter means.

3. The apparatus of claim 2 wherein:

said underflow passage means is so arranged and constructed as to eject said more dense second portion of said stream of drilling mud into said well annulus at an angle to a longitudinal axis of said tubular outer housing in a range of about 30° to about 45°.

4. The apparatus of claim 1, wherein:

said second conduit means is further characterized as an underflow passage means disposed in said upper adapter means.

5. The apparatus of claim 4, wherein:

said underflow passage means is so arranged and constructed as to eject said more dense second portion of said stream of drilling mud into said well annulus at an angle to a longitudinal axis of said tubular outer housing in a range of about 30° to about 45°.

6. The apparatus of claim 4, wherein:

said underflow passage means includes a plurality of underflow passageways circumferentially spaced around a central longitudinal axis of said upper adapter means.

7. The apparatus of claim 4, wherein:

said upper adapter means has an ejection pocket disposed in an outer surface thereof, and an upper end of said underflow passage means communicates with a surface of said ejection pocket.

8. The apparatus of claim 7, wherein:

said ejection pocket is further characterized as an open ejection pocket arranged so that said more dense second portion of said stream of drilling mud ejected from said underflow passage means will pass directly through said pocket into said well annulus without any substantial impingement upon any structure attached to said upper adapter means.

9. The apparatus of claim 1, wherein:

said upper adapter means has an ejection pocket disposed in an outer surface thereof, and an upper end of said second conduit means communicates with a surface of said ejection pocket.

10. The apparatus of claim 9, wherein:

said ejection pocket is further characterized as an open ejection pocket arranged so that said more dense second portion of said stream of drilling mud ejected from said second conduit means will pass directly through said pocket into said well annulus without any substantial impingement upon any structure attached to said upper adapter means.

11. The apparatus of claim 1, wherein:

said cyclone housing includes a plurality of axially stacked cyclone housing segments.

12. The apparatus of claim 11, wherein:

said axially stacked cyclone housing segments are held together in a state of axial compression.

13. The apparatus of claim 11, wherein:

said plurality of axially stacked cyclone housing segments include tongue and groove engaging faces between adjacent segments.

14. The apparatus of claim 13, wherein:

said cyclone housing further includes liquid sealant means between said tongue and groove engaging faces.

15. An apparatus for use in the drilling of a well with a drill bit supported by an elongated drill string having an inner bore through which a stream of drilling mud circulates to remove the cuttings of the drill bit, comprising:

a. a tool sub body having an annular bore defining a flow path and including upper and lower connections for fixing the tool sub body in a drill string above the drill bit so that drilling mud circulating through the drill string can circulate through the tool body;

b. the tool sub body including cyclone separator means centrally positioned in the annular bore receptive of drilling mud from the flow path for separating the stream of drilling mud into a less dense first portion and a more dense second portion;

c. the flow path including annular flow passage means disposed about the cyclone separator means, for flowing the stream of drilling mud from the drill string to the cyclone separator means;

d. first conduit means in the tool sub body communicating the cyclone separator means with the flow path for directing the less dense first portion of the stream of drilling mud to the drill bit; and e. second conduit means in the tool sub body communicating the cyclone separator means with the well annulus above the drill bit for directing the more dense second portion of the stream of drilling mud into the well annulus so that the hydrostatic drilling mud pressure adjacent the drill bit is reduced.

* * * * *